US005520171A

United States Patent [19]

David

[11] Patent Number: 5,520,171

[45] Date of Patent: May 28, 1996

[54] INDEXING HELICAL MAGAZINE

[75] Inventor: James C. David, Bakersfield, Calif.

[73] Assignee: Helitek, Bakersfield, Calif.

[21] Appl. No.: 222,266

[22] Filed: Apr. 4, 1994

[51] Int. Cl.[6] ..... F41B 11/02

[52] U.S. Cl. ..... 124/51.1; 124/82; 42/49.01; 89/33.02

[58] Field of Search ..... 124/45, 48, 51.1, 124/59, 72, 82; 42/49.01; 89/33.02; 221/75, 76, 262, 273, 277; 198/724, 778, 832.1

[56] References Cited

U.S. PATENT DOCUMENTS

| | | | |
|---|---|---|---|
| 84,685 | 12/1868 | Evans . | |
| 213,555 | 3/1879 | Evans . | |
| 1,285,263 | 11/1918 | Lohne . | |
| 1,304,274 | 5/1919 | De Felice . | |
| 1,487,722 | 3/1924 | Coenders . | |
| 1,747,546 | 2/1930 | Janecek . | |
| 2,631,578 | 3/1953 | Laughlin . | |
| 3,088,378 | 5/1963 | Boudreau . | |
| 3,427,923 | 2/1969 | Meyer et al. . | |
| 3,447,527 | 6/1969 | Cermak et al. . | |
| 3,726,266 | 4/1973 | Palmer | 124/59 |
| 4,034,644 | 7/1977 | Hupp et al. . | |
| 4,166,408 | 9/1979 | Wetzel et al. . | |
| 4,207,797 | 6/1980 | Gyorik | 89/34 |
| 4,384,508 | 5/1983 | Sullivan et al. . | |
| 4,676,137 | 6/1987 | Stockton et al. | 89/33.02 |
| 4,738,183 | 4/1988 | Miller et al. | 89/34 |
| 4,766,800 | 8/1988 | Miller et al. | 89/33.02 |
| 4,819,609 | 4/1989 | Tippmann . | |
| 4,831,914 | 5/1989 | Dardick et al. | 89/33.02 |
| 4,888,898 | 12/1989 | Miller et al. | 42/49.01 |
| 4,945,664 | 8/1990 | Miller | 42/49.01 |
| 4,947,572 | 8/1990 | Miller et al. | 42/49.01 |
| 4,962,604 | 10/1990 | Miller et al. | 42/49.01 |
| 4,965,951 | 10/1990 | Miller et al. | 42/49.01 |
| 5,097,816 | 3/1992 | Miller | 124/49 |
| 5,166,457 | 11/1992 | Lorenzetti | 42/49.01 |
| 5,174,807 | 12/1992 | MacDonald | 71/86 |
| 5,282,455 | 2/1994 | Adamson et al. | 124/59 |
| 5,335,579 | 8/1994 | David | 89/34 |

FOREIGN PATENT DOCUMENTS

| | | |
|---|---|---|
| 2010554 | 8/1976 | Germany . |
| 3809319 | 9/1989 | Germany . |
| 636434 | 5/1983 | Switzerland . |

*Primary Examiner*—Eric K. Nicholson
*Assistant Examiner*—John A. Ricci
*Attorney, Agent, or Firm*—Darle M. Short; Oliff & Berridge

[57] ABSTRACT

An indexing helical magazine for use with delicate projectiles, such as pellets and paint balls. The magazine has a housing with a helical rib extending partially into the housing. A carrier for the projectiles is rotatably coupled within the housing and guides the projectiles along the helical rib. An end cap coupled to the housing feeds the projectiles from the housing into the gun. A ratchet coupled to the drive member rotates the drive member via interaction with a camming member. The indexing magazine may also include a loading member for disengaging the ratchet and the carrier so that projectiles can be loaded into the carrier. Finally, the magazine may also include a stop member for preventing reverse rotation of the carrier.

24 Claims, 7 Drawing Sheets

INDEXING HELICAL MAGAZINE

FIELD OF THE INVENTION

This invention relates to an indexing helical magazine for holding and dispensing, in seriatim, a number of pellets or projectiles. More specifically, this invention relates to a magazine having a rotatable carrier which is indexed each time the gun is operated, such that a pellet or projectile is dispensed from the magazine to the gun each time the gun is operated.

BACKGROUND OF THE INVENTION

Conventional magazines with helical feed members are common. Such conventional magazines are designed primarily for use with conventional bullets and thus, most are not designed to handle delicate projectiles. Stated differently, most of these conventional magazines place relatively large forces on the projectiles contained therein and thus, must be used with durable projectiles. Such magazines are not suitable for use with air guns and pellets or paint balls which are relatively fragile. For example, some of these conventional magazines rely on gravity and pressure or a belt system to feed the projectiles into the gun. Such systems will damage more delicate projectiles such as pellets and paint balls.

Examples of these conventional magazines are disclosed in U.S. Pat. Nos. 213,555 issued on Mar. 25, 1879 to Evans; 84,685 issued on Dec. 8, 1868 to Evans; 1,285,263 issued on Nov. 19, 1918 to Lohne; 3,088,378 issued on May 7, 1963 to Boudreau; 3,427,923 issued on Feb. 18, 1969 to Meyer et al.; 4,034,644 issued on Jul. 12, 1977 to Hupp et al.; 4,166,408 issued on Sep. 4, 1979 to Wetzel et al.; 4,384,508 issued on May 24, 1983 to Sullivan et al.; 4,676,137 issued on Jun. 30, 1987 to Stockton et al.; 4,738,183 issued on Apr. 19, 1988 to Miller et al.; 4,766,800 issued on Aug. 30, 1988 to Miller et al.; 4,888,898 issued on Dec. 26, 1989 to Miller et al.; 4,945,664 issued on Aug. 7, 1990 to Miller et al.; 4,947,572 issued on Aug. 14, 1990 to Miller et al.; 4,962,604 issued on Oct. 16, 1992 to Miller et al.; 4,965,951 issued on Oct. 30, 1990 to Miller et al.; and West German Patent Nos. 2,010,554 and 3,809,319.

Other magazines have been developed for use with air guns and delicate projectiles such as pellets or paint balls. However, these magazines also have several disadvantages. For example, some of them also depend on gravity to feed the projectile into the gun. Others use a complicated belt arrangement which is not practical for air gun pellets. Still others are unreliable and easily damaged.

Examples of magazines designed for use with pellets and paint balls are disclosed in U.S. Pat. Nos. 4,819,609 issued Apr. 11, 1989 to Tippman and 5,166,457 issued Nov. 24, 1992 to Lorenzetti.

In view of the above, it is apparent that a need exists for an improved helical indexing magazine for use with air guns and pellets or paint balls. This invention addresses this need in the art, along with other needs which will become apparent to those skilled in the art once given this disclosure.

A prior patent which addresses this need is U.S. Pat. No. 5,097,816 issued on Mar. 24, 1992 to Miller.

SUMMARY OF THE INVENTION

This invention provides an indexing magazine for storing and dispensing projectiles to a gun. The magazine includes a housing, a drive member, a release member, a rotating member and a camming member. The housing has a first end, a second end, a passageway extending from the first end to the second end along a longitudinal axis, a helical member extending partially from the first end to the second end and into the passageway and an end cap at the first end. The drive member is rotatably coupled within the housing and has a plurality of extensions or projections for guiding the projectiles along the helical member. The release member is coupled to the second end of the housing and to the drive member and feeds the projectiles from the housing into the gun. The rotating member is coupled to the drive member and rotates the drive member. The camming member is slidably coupled to the rotating member and movable between a first position and a second position. The rotating member slidably engages the camming member. When the camming member moves from its first position to its second position and the rotating member rotates in a first direction, camming member slides relative the adjacent extension. When the camming member moves from its second position to its first position, the rotating member rotates in a second direction, engages the extension and rotates the drive member.

In some embodiments of this invention, the magazine further includes a loading member. The loading member is coupled to the first end of the housing for disengaging the rotating member from the drive member so that projectiles can be loaded into the drive mender.

In other embodiments of this invention, the magazine further includes a stop member which prevents the drive member from rotating as the camming member moves from its first position to its second position.

In yet other embodiments, the rotating member includes a first abutment surface extending parallel to the longitudinal axis and a first inclined surface extending angularly to the longitudinal axis. The first inclined surface engages the adjacent extension as the camming member moves from its first position to its second position and biases the rotating member such that it slides over the adjacent extension. The first abutment surface engages the extension as the camming member moves from its second position to its first position and rotates the drive member.

In other embodiments, the rotating member includes a second abutment surface and a second inclined surface similar to the first and second like surfaces discussed above.

In further embodiments, the rotating member includes a ratchet disk and a pin fixedly coupled to the disk and extending outwardly from the disk into slidable engagement with the camming member. The first and second surfaces extend from the ratchet disc.

In further embodiments, the camming member includes a first end portion extending parallel to the longitudinal axis, a center portion extending angularly to the longitudinal axis and a second end portion extending parallel to the longitudinal axis.

In yet further embodiments, the center portion of the camming member pivots the rotating member in the first direction as the camming member moves from its first position to its second position and pivots the rotating member in the second direction as the camming member moves from its first position to its second position.

The magazines according to this invention have many advantages over the prior magazines, including the following. One advantage of the magazines according to this invention is that they minimize the force on the projectiles contained therein to reduce the risk of damage if fragile projectiles are being used. Specifically, the helical rib, flutes and arms support and protect the projectiles. The arms gently feed the projectiles into the release member.

Another advantage of the magazines according to this invention is that they are very reliable since they are driven by the camming bolt.

A further advantage of the magazines according to this invention is that they are sturdy and resist operator damage.

Yet another advantage of the magazines according to this invention is that they are easy to manufacture since they have only a few parts and are easy to assemble.

Other advantages and salient features of the magazines according to this invention will become apparent from the disclosure.

BRIEF DESCRIPTION OF THE DRAWINGS

Referring to the drawings which form a part of this disclosure.

DETAILED DESCRIPTION OF THE INVENTION

Figure 1:
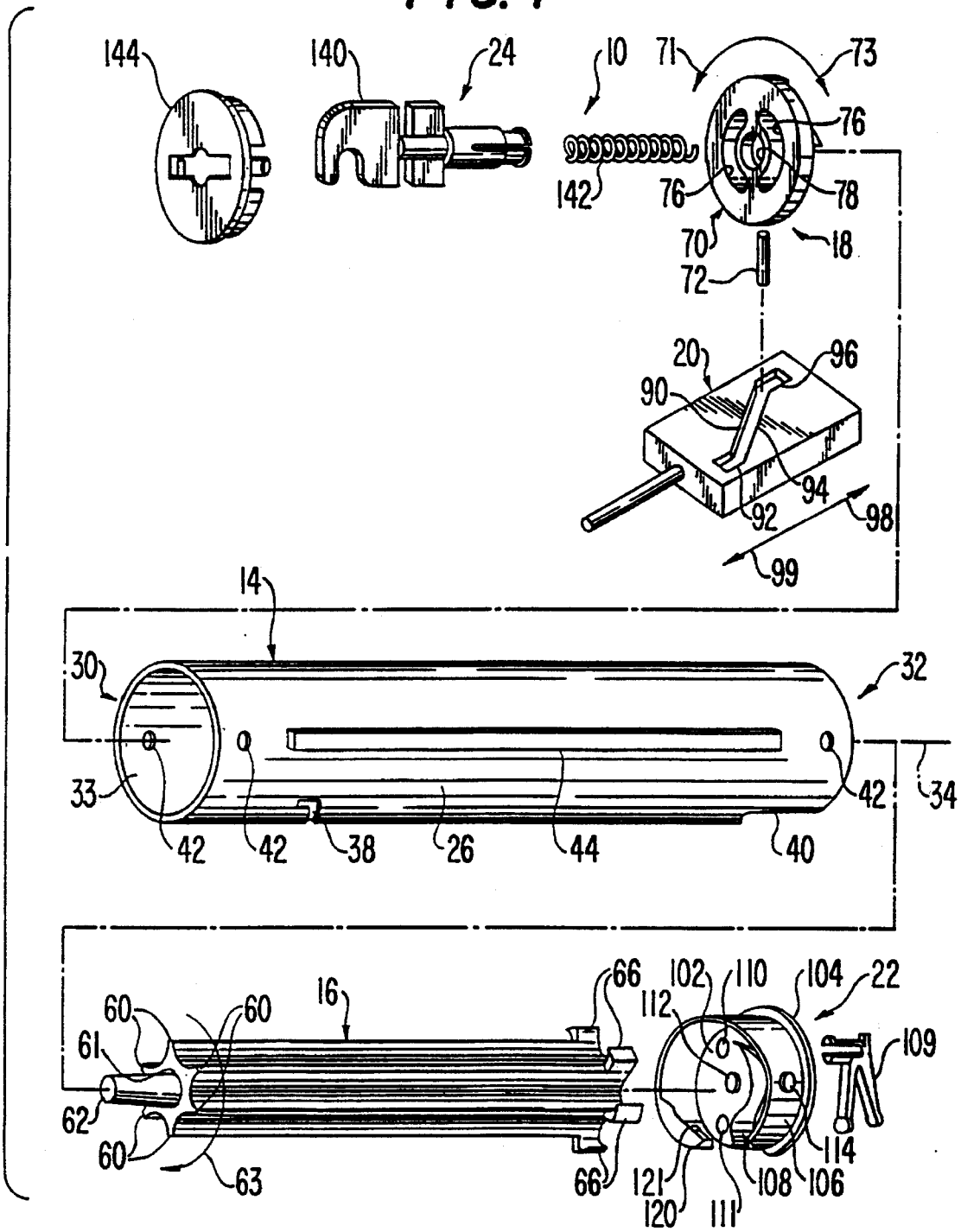
FIG. 1 is an exploded view of an indexing helical magazine in accordance with the present invention.
Figure 2:
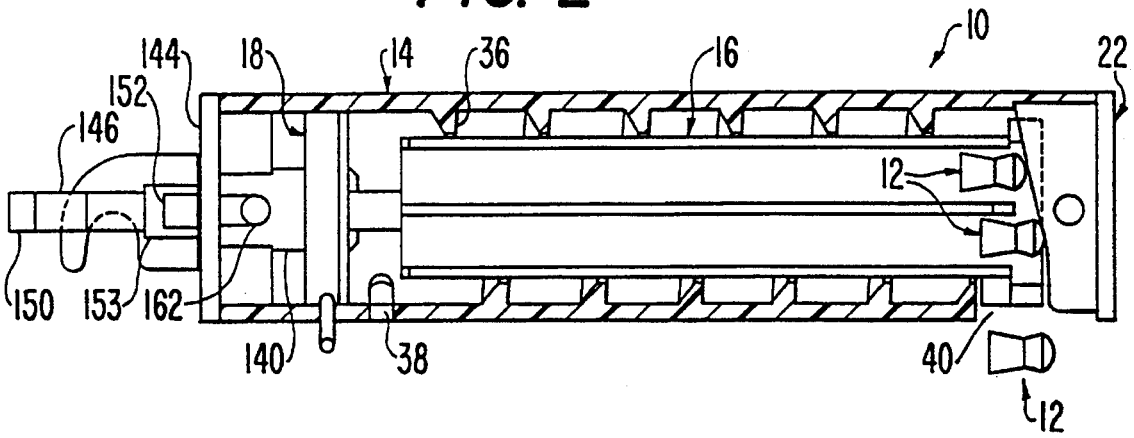
FIG. 2 is a longitudinal cross-section of the cylindrical shell of the housing of the magazine of FIG. 1 with the other parts of the magazine shown in full and with sample pellets added for clarity, and depicting the magazine in the loading position.
Figure 3:
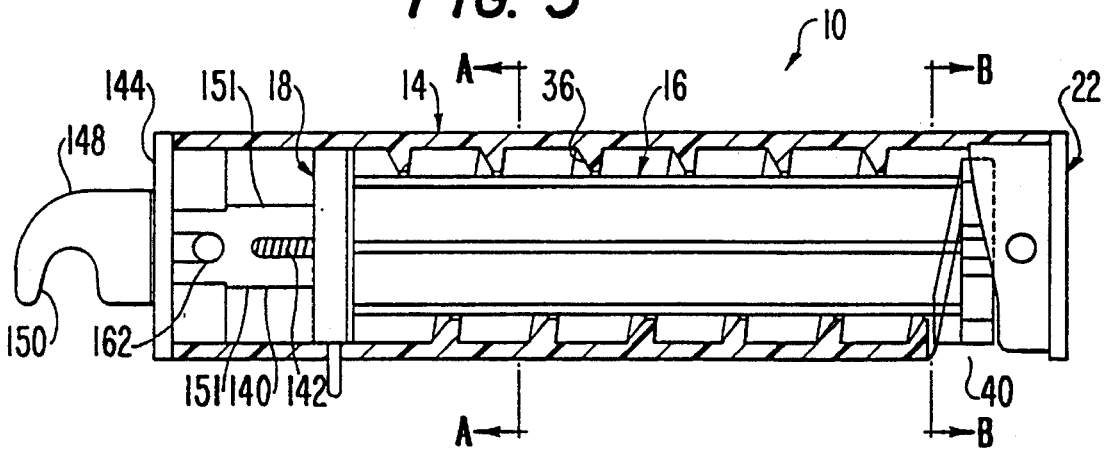
FIG. 3 is a longitudinal cross-section of the cylindrical shell of the housing of the magazine of FIG. 1 with the other parts of the magazine shown in full, and depicting the magazine in the loaded position.

Referring to the Figures, and in particular FIGS. 1–3, one embodiment of an indexing helical magazine according to this invention, magazine 10, is illustrated. Magazine 10 can be used with any type of projectiles, but has features and advantages which render it particularly useful with an air gun employing fragile projectiles such as pellets or paint balls 12. Magazine 10 includes housing 14, carrier 16, ratchet 18, camming bolt 20, end cap assembly 22, and loading member 24. Magazine 10 is indexed via the interaction of ratchet 18, camming bolt 20 and end cap assembly 22, as discussed in detail below. Pellets 12 are loaded into magazine 10 by loading member 24.

Housing 14, as illustrated in FIGS. 1–3 and 6–8, is generally cylindrical and includes cylindrical shell 26, interior spiral or helical rib 36, and flanges 44.

Cylindrical shell 26 has first end 30, second end 32 and longitudinal axis 34. Cylindrical passageway 33 is defined by the inner surface of cylindrical shell 26. Cylindrical shell 26 has L-shaped slot 38 therein adjacent first end 30, cutout 40 therein at second end 32 and a pair of assembly holes 42 therein at each of first end 30 and second end 32.

Rib 36 projects into passageway 33 from the interior surface of cylindrical shell 26. In this embodiment, rib 36 extends partially from first end 30 to second end 32 (between L-shaped slot 38 and cut-out 40, see FIG. 6) and spirals toward the second end 32. Rib 36 has a curvature such that individual pellets 12 fit relatively snugly between adjacent walls thereof.

Figure 7:
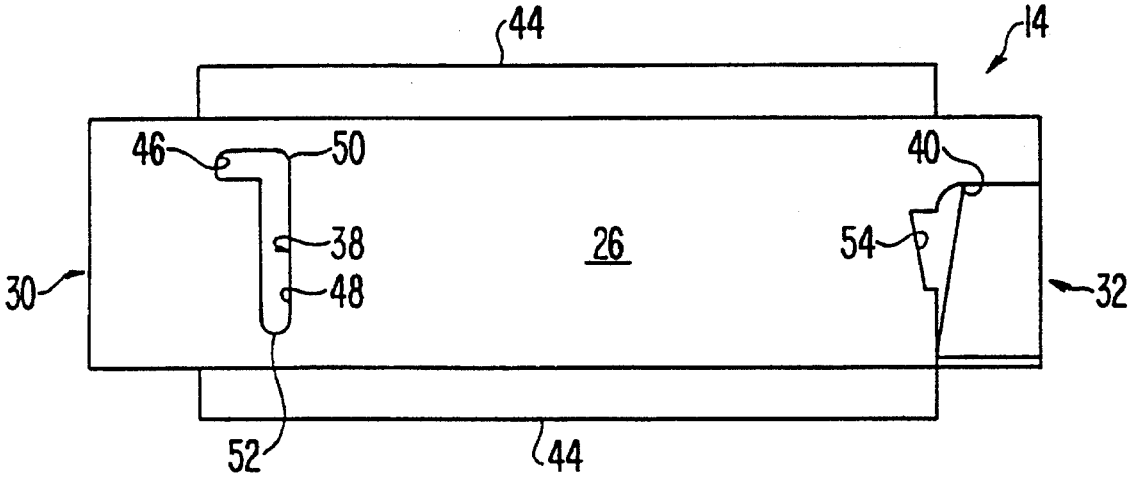
FIG. 7 is a bottom plan view of the cylindrical shell of FIG. 6.
Figure 8:
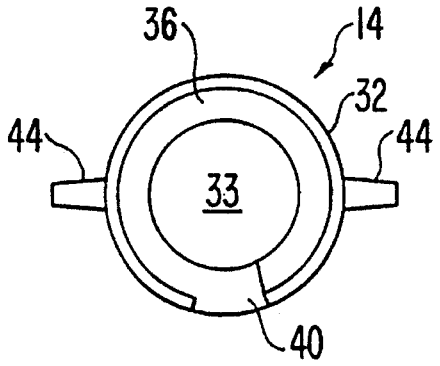
FIG. 8 is a right end view of the cylindrical shell of FIG. 6.
Figure 9:
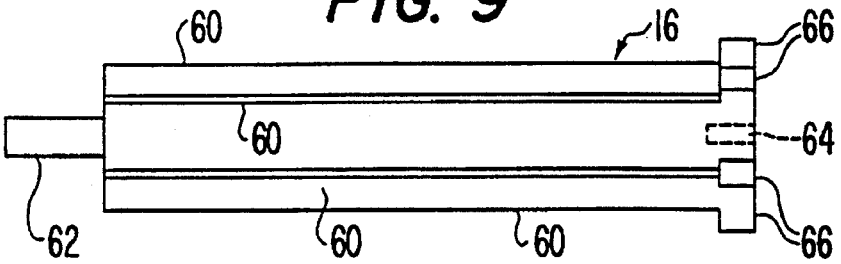
FIG. 9 is a side view of the carrier of the magazine of FIG. 1.
Figure 10:
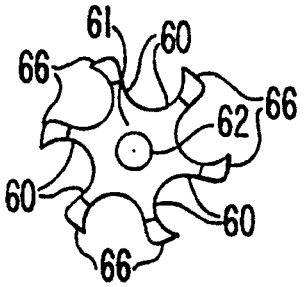
FIG. 10 is a left-end view of the carrier of FIG. 9.
Figure 11:
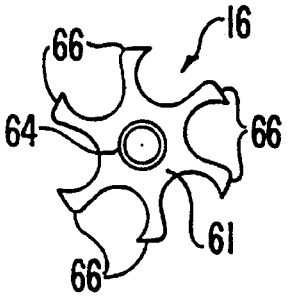
FIG. 11 is a right-end view of the carrier of FIG. 9.
Figure 12:
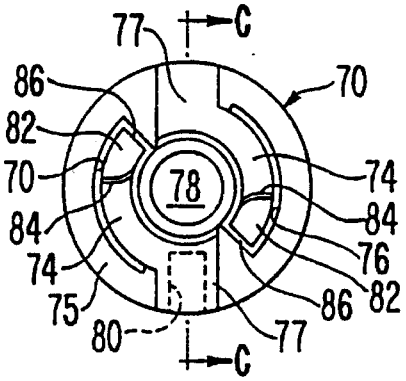
FIG. 12 is a right-end view of the ratchet disk of the magazine of FIG. 1.
Figure 13:
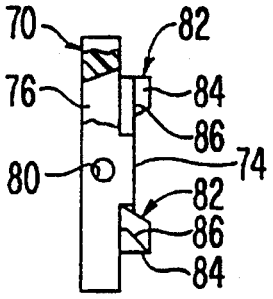
FIG. 13 is a bottom view of the ratchet disk of the magazine of FIG. 1, partially broken away to illustrate the leg openings.
Figure 14:
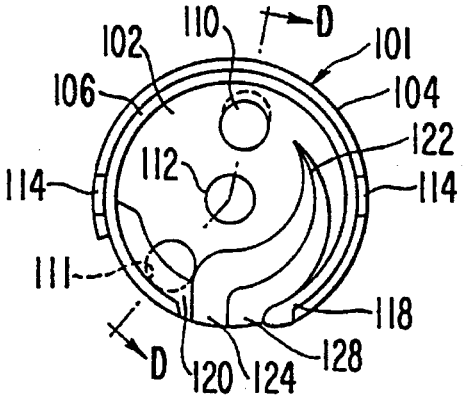
FIG. 14 is a left-end view of the plug of the magazine of FIG. 1.

L-shaped slot 38 has first leg 46 and second leg 48 which intersect at intersection 50 to form an "L", as illustrated in FIG. 7. First leg 46 extends longitudinally in cylindrical shell 26, parallel to longitudinal axis 34. Second leg 48 includes second end 52, opposite intersection 50. From intersection 50, second leg 48 extends perpendicularly to first leg 46 to second end 52. Second leg 48 is longer than first leg 46.

Cut-out 40 is substantially rectangular with an angular portion 54, see FIG. 7.

Assembly holes 42 have the same diameter. Each pair of holes 42 at each end 30 and 32 is diametrically opposed, i.e., spaced 180° apart.

Flanges 44 extend outwardly from the exterior of cylindrical shell 26 parallel to longitudinal axis 34. Flanges 44 are also spaced 180° apart. Each flange 44 extends in line with a pair of assembly holes 42, one at each end of cylindrical shell 26, but is spaced inward from both of these assembly holes 42, see FIG. 1.

Carrier or drive member 16 is substantially cylindrical and includes cylindrical core 61, a plurality of flutes or projections 60, shaft 62, hole 64 and arms 66, as illustrated in FIGS. 1 and 9–11. Carrier 16 is rotatably coupled within cylindrical shell 26, as discussed below.

Cylindrical core 61 extends along longitudinal axis 34 of cylindrical shell 26 of housing 14 when magazine 10 is properly assembled.

Preferably, six evenly spaced apart flutes 60 extend outwardly from cylindrical core 61, parallel to longitudinal axis 34. Flutes 60 are designed such that pellets 12 fit individually between adjacent flutes 60. The outermost diameter of flutes 60 is less than the innermost diameter of rib 36 so that carrier 16 can rotate within rib 36.

Arms 66 extend outwardly from the end of flutes 60 adjacent second end 32 of cylindrical shell 26. The ends of arms 66 are slightly curved in the direction opposite from the direction in which carrier 16 rotates (as depicted by arrow 63 in FIG. 1). The curvature of arms 66 is such that arms 66 protect and guide pellets 12 into end cap 22, as discussed below.

Shaft 62 extends outwardly from cylindrical core 61 along longitudinal axis 34 toward first end 30 and is cylindrical. Hole 64 is cylindrical and extends partially through the center of cylindrical core 61 at second end 32 of cylindrical shell 26 along longitudinal axis 34.

Ratchet or rotating member 18 includes a main body 70 and pin 72. Ratchet 18 rotates in a first direction 71 and a second direction 73, see FIGS. 4 and 5. Ratchet 18 engages flutes 60 and is rotatably coupled within housing 14 adjacent first end 30 of cylindrical shell 26, as discussed below.

Main body or disk 70, as illustrated in FIGS. 1, 12, 13 and 13A, includes outer ring 75, raised leg bases 77, resilient legs 74, leg openings 76, center hole 78 and pin bore 80. Main body 70 is cylindrical.

Outer ring 75 basically forms the outer circumference of disk 70. There are two leg bases 77 which are diametrically opposed. Leg bases 77 are integral with outer ring 75 and extend above or outwardly from the surface of outer ring 75.

Preferably, there are two resilient legs 74 and leg openings 76. Each leg 74 extends from a leg base 77 and is located over a leg opening 76. The two pairs of legs 74 and leg openings 76 are identical and located 180° apart. Leg openings 76 are located and of a size greater than legs 74 so that each leg opening 76 can receive a leg 74 therein, as discussed below.

Each leg 74 extends arcuately around the center of main body 70. Each leg 74 includes a ratchet tooth 82 at its outermost end having abutment surface 84 and inclined surface 86.

Inclined surfaces 86 start at the free end of legs 74 and slope outwardly to abutment surfaces 84. Abutment surfaces 84 extend outwardly parallel to the longitudinal axis 34.

Each leg opening 76 extends through main body 70 arcuately around the center of main body 70. Center hole 78 is cylindrical and extends through the center of main body 70. Pin bore 80 is cylindrical and extends perpendicularly to longitudinal axis 34 partially through main body 70, preferably spaced 90° from each ratchet tooth 82. Pin bore 80 is in alignment with L-shaped slot 38 of cylindrical shell 26 when magazine 10 is properly assembled.

Pivot pin 72 is preferably cylindrical. It is press-fit into bore 80 and extends outwardly from main body 70 through L-shaped slot 38 of housing 14 when magazine 10 is properly assembled.

Camming bolt 20, as seen in FIG. 1, includes a preferably substantially rectangular shaped groove 90. Groove 90 receives the lower end of pin 72. Camming bolt 20 can take many forms. For instance, it may be a trigger, pump or lever of a gun. When the gun to which magazine 10 is attached is operated, bolt 20 moves translationally and rearwardly toward first end 30 into a first position 98 and forwardly toward second end 32 into a second position 99. Stated differently, bolt 20 reciprocates linearly between positions 98 and 99 as the gun is operated.

Second end cap assembly or release member assembly 22 includes plug 101 and detent 109. Plug 101 includes, basically, inner wall 102, outer wall 104, and spiral side wall 106, as illustrated in FIGS. 1, 14, 14A and 14B. End cap 22 is substantially cylindrical and is coupled to housing 14 at second end 32 of cylindrical shell 26.

When magazine 10 is properly assembled, inner wall 102 is adjacent flutes 60 and arms 66 of carrier 16. Outer wall 104 forms the exterior end wall at second end 32 of cylindrical shell 26 and is substantially the same diameter as cylindrical shell 26.

Outer wall 104 has elongated slot 103 therein which receives detent 109, as discussed below. Inner wall 102 has feeding groove 108, hole 110 and hole 111 therein, and plug 112 extending inwardly.

Feeding groove 108 has a beginning point 122 and an end point 124. Feeding groove 108 extends into inner wall 102 and, in this embodiment, is shaped triangularly in cross section. Feeding groove 108 begins at beginning point 122 and continuously deepens as it extends arcuately to its end point 124. End point 124 aligns with cut-out 40 of housing 14 when magazine 10 is properly assembled.

Figure 14A:
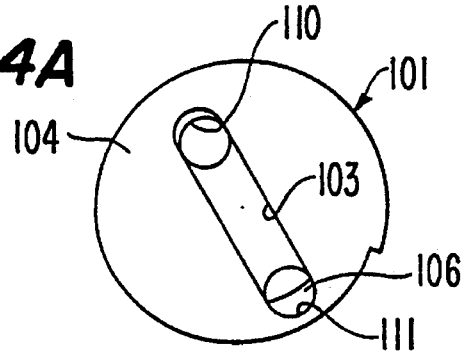
FIG. 14A is a right-end view of the plug of the magazine of FIGS. 1 and 14.
Figure 14B:
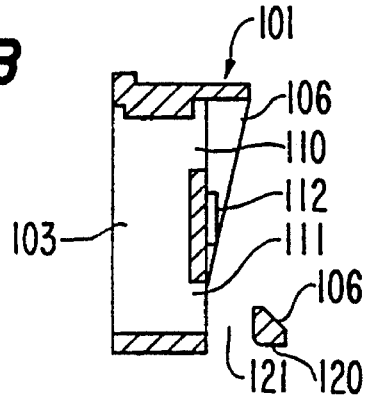
FIG. 14B is a cross-section of the plug of FIGS. 14 and 14A along line D—D of FIG. 14.
Figure 16:
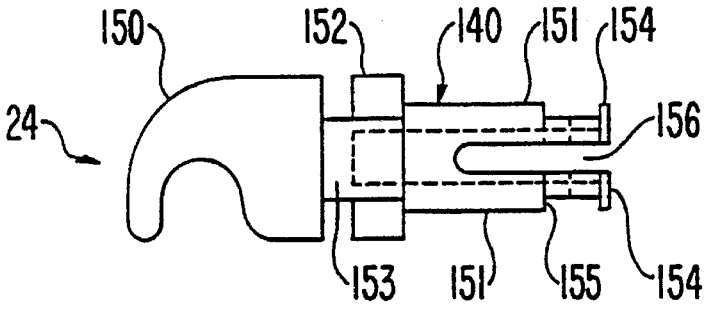
FIG. 16 is a side view of the body of the loading assembly of the magazine of FIG. 1.
Figure 17:
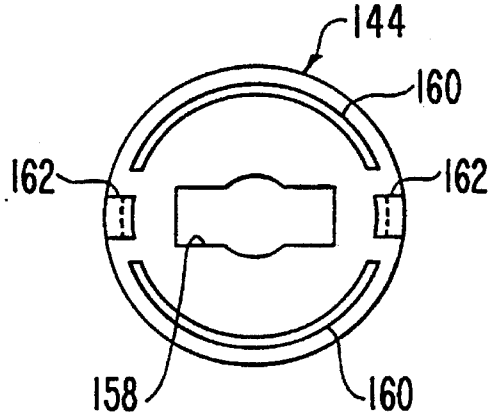
FIG. 17 is a right-end view of the end cap of the magazine of FIG. 1.
Figure 18:
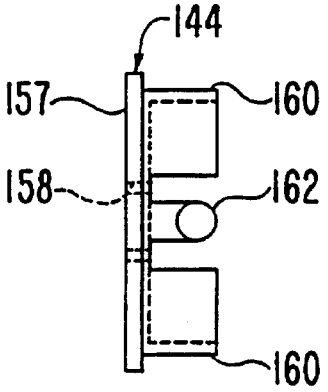
FIG. 18 is side view of the end cap of FIGS. 1 and 17.

Holes 110 and 111 extend from inner wall 102 to slot 103 in outer wall 104 (see FIG. 14B). Holes 110 and 111 receive legs 130 and 131 of detent 109, as discussed below.

Spiral side wall or flange 106 includes first end 118 and second end 120. Spiral side wall 106 spirals outwardly from its lowest height at inner wall 102 at its first end 118 to its greatest height at second end 120. Spiral side wall 106 has a diameter slightly smaller than the internal diameter of cylindrical shell 26 so that end cap assembly 22 is received within shell 26. Thus, spiral side wall 106 fits snugly within second end 32 of cylindrical shell 26 such that outer wall 104 forms an end of housing 14.

The second end 120 of spiral side wall 106 angles inwardly to form a wedge-shape (see FIG. 14B). Second end 120 of spiral flange 106 has a slot 121 therein adjacent inner wall 102 of end cap 22.

Spiral side wall 106 also includes buttons 114 protruding outwardly therefrom, spaced approximately 180° apart. Buttons 114 are located and are of a size to be received in a pair of holes 42 in cylindrical shell 26 to connect plug 101 to cylindrical shell 26.

Plug 112 is cylindrical and is received within hole 64 of carrier 16 when magazine 10 is properly assembled.

Figure 15:
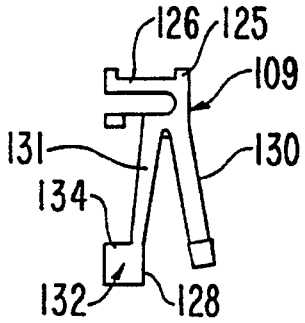
FIG. 15 is a side view of the detent of the magazine of FIG. 1.
Figure 13A:
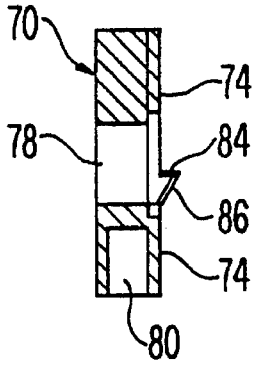
FIG. 13A is a cross-section of the ratchet disk of FIGS. 12 and 13 along line C—C of FIG. 12.

Detent 109 is received within slot 103 and holes 110 and 111 and includes head flange 125, coupling arms 126, and legs 130 and 131, as illustrated in FIGS. 1 and 15. Head flange 125 is substantially flush with outer wall 104 when magazine 10 is properly assembled. Coupling arms 126 extend outwardly from head flange 125 and snap-fit into hole 110. Legs 130 and 131 extend substantially perpendicularly to arms 126. The leg 131 includes stop member 128 which is received within hole 111. Stop member 128 includes stop surface 132 and inclined surface 134. Leg 130 extends angularly outwardly from the innermost leg 131. When magazine 10 is properly assembled and attached to a gun, a portion of the gun depresses leg 130 toward second face 104 and biases legs 131 such that stop member 128 is pushed through hole 111 into engagement with fingers 66.

Loading assembly 24, as illustrated in FIGS. 1 and 16–18, includes body 140, spring 142 and first end cap 144. Loading assembly 24 is coupled to first end 30 of cylindrical shell 26 so that body 140 is pivotable 90° between a first unloaded position 146, as illustrated in FIG. 2, and a second loaded position 148, as illustrated in FIG. 3.

Body 140 includes head 150, middle portion 153, arms 152 and legs 151. Head 150 extends outwardly from middle portion 153 beyond first end 30 of cylindrical shell 26 when magazine 10 is properly extended and can be grasped to pivot loading member body 140 between its unloaded and loading positions 146 and 148, respectively. Legs 151 extend outwardly from middle portion 153. Each leg 151 includes shelf 155 and retaining dog 154. Legs 151 together form a cylinder with side slots for resiliency. Slotted bore 156 is formed between legs 151.

Legs 151, when magazine 10 is properly assembled, extend into first end 30 of cylindrical shell 26 and are rotatably received within hole 78 of ratchet member 18 via a snap-fit. Slotted bore 156 receives shaft 62 of carrier 16 and spring 142.

Arms 152 extend outwardly from middle portion 153 and perpendicularly to longitudinal axis 34 and are spaced apart from head 150.

Spring or biasing member 142 is preferably a common coil spring. Spring 142 is received within slotted bore 156 formed by legs 151, and spring 142 itself receives shaft 62 of carrier 16.

First end cap 144 includes end wall 157, collars 160 and buttons 162. First end cap 144 is coupled to first end 30 of cylindrical shell 26.

End wall 157 is substantially the same diameter as cylindrical shell 26 and has slot 150 therein. Collars 160 have substantially the same diameter as the interior of cylindrical shell 26 so that first end cap 144 fits snugly within first end 30 of cylindrical shell 26. End cap slot 158 extends through end cap face 157 and receives loading member body 140 therethrough. End cap slot 158 is designed such that arms 152 of loading member 24 will fit through slot 158 when arms 152 are substantially in alignment with slot 158, but will not fit through slot 158 when out of alignment with slot 158. In first unloaded position 146, i.e., when arms 152 are in alignment with slot 158, arms 152 of loading member body 140 are biased through end cap slot 158 by spring 142 acting on carrier 16. In the second loaded position 148, arm 152 of loading member body 140 extends perpendicularly to end cap slot 158 thereby locking ratchet member 18 in engagement with carrier 16.

Buttons 162 extend from end cap face 157 and snap-fit into holes 42 at first end 30 of cylindrical shell 26 to couple first end cap 144 to cylindrical shell 26.

ASSEMBLY AND OPERATION

To assemble magazine 10, carrier 16 is inserted through second end 32 of cylindrical shell 26. Spring 142 is then inserted into slotted bore 156 formed by legs 151 of loading member body 140, and legs 151 are inserted through center hole 78 of ratchet 18 and coupled via snap-fit to ratchet 18. More specifically, legs 151 resiliently bias inwardly until they fit through center hole 78. Legs 151 bias outwardly after dogs 154 pass through center hole 78 of ratchet 18, such that dogs 154 and shelf 155 couple ratchet 18 to legs 151. Ratchet 18 is rotatably coupled to legs 151.

Shaft 62 is then inserted into slotted bore 156 and spring 142. Ratchet 18 is oriented so that pin bore 80 is aligned with L-shaped slot 38 in cylindrical shell 26. First end cap 144 is then coupled to first end 30 of cylindrical shell 26 with head 140 of loading member 24 extending through slot 158 in first end cap 144. Specifically, buttons 162 are aligned with holes 42 at first end 30 of cylindrical shell 26 and couple end cap 144 to first end. 30 via a snap-fit. At second end 32 of cylindrical shell, end cap 22 is coupled thereto via a snap-fit also. Specifically, buttons 114 snap into holes 42 at second end 32 to couple end cap 22 to second end 32. Plug 112 of plug 101 is received in hole 64 of carrier 16. Finally, one end of pivot pin 72 is pressed into pivot pin bore 80 of ratchet 18 through L-shaped slot 38 of housing 14.

The loading of magazine 10 with pellets 12 is illustrated in FIG. 2. Loading member body 140 is positioned such that arms 152 are in alignment with end cap slot 158. In this position, spring 142, which has one end in abutment with carrier 16, forces loading assembly body 140 outwardly to its outermost position, position 146, as illustrated in FIG. 2. In this position, the top of legs 151 abut the area of end cap 144 immediately adjacent slot 158 (because the top of legs 151 will not fit through slot 158) and prevent further outward movement of loading assembly 24. When loading member body 140 is in outermost position 146, ratchet 18 is disengaged from carrier 16 and pin 72 is located in first leg 48 of L-shaped slot 38. When ratchet 18 is disengaged from carrier 16, carrier 16 rotates freely within cylindrical shell 26 since abutment surfaces 84 of ratchet 18 are not in engagement with flutes 60 of carrier 16.

Pellets 12 are then loaded through cut-out 40 at second end 32 of housing 14 between each flute 60 as desired. Carrier 16 can be rotated such that all of the valleys between adjacent flutes 60 can be filled with pellets 16, i.e., each valley is in alignment with slot 40. During this rotation, arms 66 of flutes 60 at second end 32 bias or slide over inclined surface 134 of stop member 128.

Once magazine 10 is loaded with pellets 12, loading member body 140 is forced inwardly to innermost position 148 and pivoted 90°, as illustrated in FIG. 3. During this movement of loading member body 140, end cap wall 157 is received between arms 152 and head 158 of loading member body 140 to lock loading member body 140. Pin 72 is moved into first end or intersection 50 of second leg 48 of L-shaped slot 38.

Figure 3A:
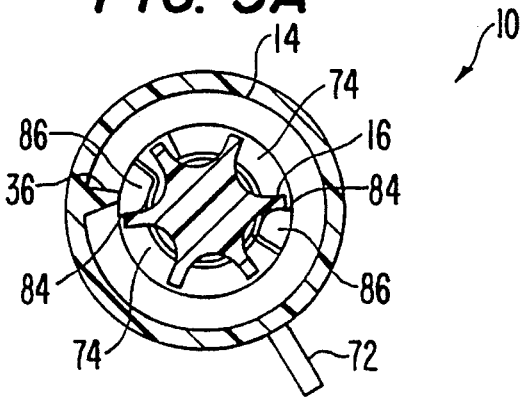
FIG. 3A is a transverse cross-section of the magazine of FIGS. 1–3 along line A—A of FIG. 3, illustrating the ratchet in its first position.
Figure 5:
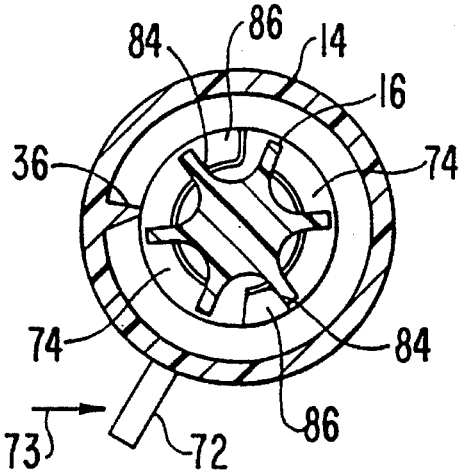
FIG. 5 is a transverse cross-section of the magazine of FIGS. 1–3 along line A—A of FIG. 3, illustrating the ratchet moving from its second position to its first position.
Figure 5A:
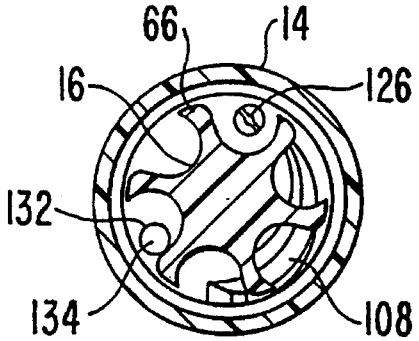
FIG. 5A is a transverse cross-section of the magazine of FIG. 1–3 along line B—B of FIG. 3, illustrating the stop member sliding over the carrier as it is rotated by the ratchet.
Figure 6:
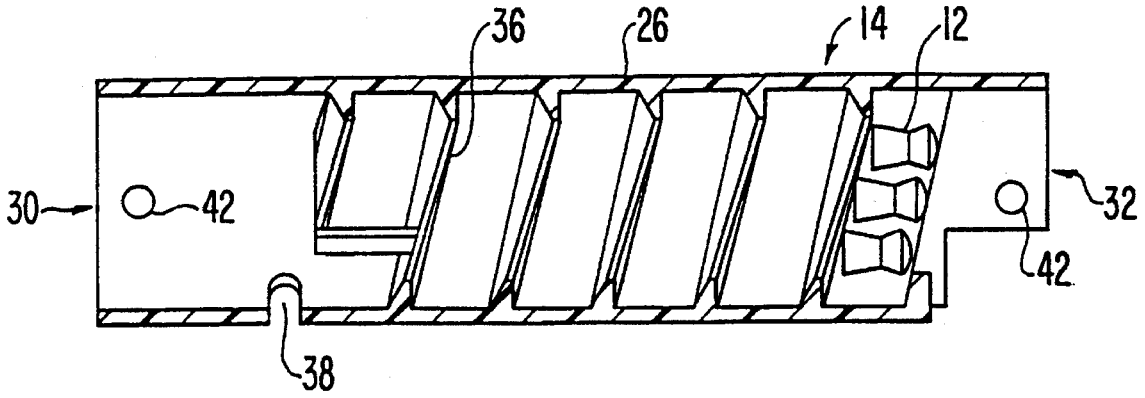
FIG. 6 is a longitudinal cross-section of the cylindrical shell of the housing of the magazine of FIG. 1 with sample pellets added for clarity.

Before inserting pin 72 of magazine 10 into camming bolt 20, ratchet 18 must be pre-set. This is done by manually moving pin 72 from first end 50 of second leg 48 to second end 52 of second leg 48 as illustrated in FIG. 5. As pin 72 is moved, ratchet 18 rotates in its second direction 73 (see FIG. 5), and abutment surfaces 84 engage the next adjacent flute 60 and rotate carrier 16 until pin 72 reaches second end 52 of second leg 48 as illustrated in FIG. 3A. During this rotation, at second end 32 of housing 14, a flute 60 biases or slides over inclined surface 134 of stop member 128 of leg 131 of detent 109 as illustrated in FIG. 5A. Pin 72 is then inserted into first end portion 92 of cam groove 90 of camming bolt 20 with camming bolt 20 in its first position 98.

Figure 4:
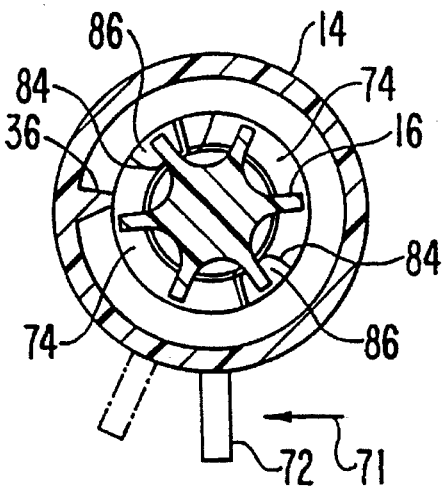
FIG. 4 is a transverse cross-section of the magazine of FIGS. 1–3 along line A—A of FIG. 3, illustrating the ratchet moving from its first position to its second position.
Figure 4A:
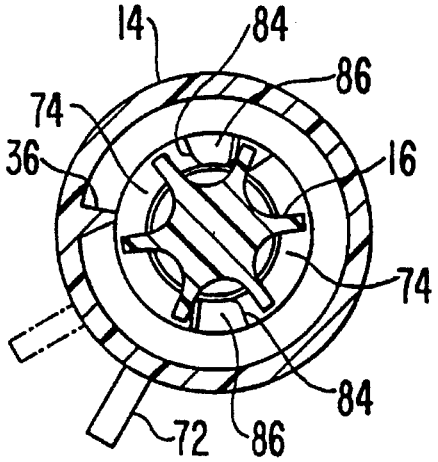
FIG. 4A is a transverse cross-section of the magazine of FIGS. 1–3 along line A—A of FIG. 3, illustrating the ratchet in its second position.

In operation, camming bolt 20 starts in first position 98 with pin 72 received in first end portion 92 of cam groove 90. When the gun to which magazine 10 is attached is activated, camming bolt 20 is moved from its first position 98 to its second position 99. This action moves groove 90 relative pivot pin 72 such that pin 72 moves from being received in first end portion 92 to being received in second end portion 96, passing through angled portion 94. Since camming bolt 20 is limited to linear reciprocal movement, this movement of camming bolt 20 relative to pin 72 causes pin 72 to rotate in an arc around longitudinal axis 34. Since cylindrical shell 26 is stationery, this movement results in pin 72 moving from second end 52 of second leg 48 of L-shaped slot. 38 to first end 50 of leg 48. Center angled portion 94 cams pivot pin 72. Since pin 72 is affixed to ratchet 18, this action of pin 72 rotates ratchet 18 in a first direction 71 as illustrated in FIGS. 4 and 4A. When ratchet 18 rotates in first direction 71, inclined surfaces 86 of ratchet teeth 82 engage and slide over the next adjacent flutes 60 as illustrated in FIG. 4. Carrier 16 is held in position and does not rotate due to stop member 128 at second end 32 of cylindrical shell 26. Specifically, stop surface 132 of stop member 128 is in engagement with an arm 66 of flute 60 and prohibits rotation of carrier 16.

When camming bolt 20 is moved from its second position 99 back to its first position 98, camming bolt 20 moves relative pin 72 such that pin 72 moves from second end portion 96 to first end portion 92, through angled portion 94. This action rotates pin 72 in an arc around longitudinal axis 34. Pin 72 moves, in second leg 48 of L-shaped slot 38, from the first end 50 to the second end 52. This rotational movement of pin 72 also simultaneously rotates main body 70 of ratchet 18 in second direction 73 as seen in FIG. 5. When ratchet 18 is rotated in second direction 73, abutment surfaces 84 of ratchet teeth 82 engage one of flutes 60, and thus rotate carrier 16 with ratchet 18. Carrier 16 is preferably rotated a distance substantially equal to the diameter of one pellet. As carrier 16 is rotated, arms 66 at the second end 32 bias or slide over inclined surface 134 of stop member 128 as illustrated in FIG. 5A.

Additionally, as carrier 16 rotates, pellets 12 are driven along carrier 16 by spiral 36 of housing 14. One pellet 12 is guided by a flute 60, spiral side wall 106 of plug 101, feeding groove 108 of plug 701, and out of magazine 10 through cut-out 40 of housing 14 and into the gun to which magazine 10 is attached.

This process can be repeated, and another pellet discharged from the magazine 10 to the gun, until magazine 10 is emptied of pellets 12. Then magazine 10 may be reloaded with pellets 12, as set forth above as desired.

Various modifications, improvements and other embodiments will become apparent to those skilled in the art once given this disclosure. Such modifications, improvement and other embodiments are considered to be within the scope of this invention as defined by the following claims.

What is claimed is:

1. An indexing magazine for storing and dispensing projectiles to a gun, comprising:

a housing having a first end, a second end, a passageway extending from said first end to said second end along a longitudinal axis, a helical member extending partially from said first end to said second end into said passageway and an end cap at said first end;

a drive member rotatably coupled within said housing and having a plurality of projections for guiding the projectiles along said helical member;

a release member coupled to said second end of said housing and to said drive member for feeding the projectiles from said housing into the gun;

a rotating member coupled to said drive member such that when said rotating member is rotated in a first direction it positively rotates said drive member but does not rotate said drive member when said rotating member is rotated in a second direction; and a camming member slidably coupled to said rotating member and movable between a first position and a second position, said rotating member slidably engaging said camming member as said camming member moves from its said first position to its said second position and rotating in said second direction;

said rotating member slidably engaging said camming member as said camming member moves from its said second position to its said first position and rotating in said first direction, thereby rotating said drive member and dispensing one of the projectiles.

2. A magazine as in claim 1, wherein said rotating member includes a first abutment surface extending substantially parallel to said longitudinal axis and a first inclined surface extending angularly to said longitudinal axis, said first inclined surface engages said adjacent projection when said rotating member rotates in said second direction such that said adjacent projection slides relative said first inclined surface;

said first abutment surface engages said projection when said rotating member rotates in said first direction to its said first position and rotates said drive member.

3. A magazine as in claim 2, wherein said rotating member includes a ratchet disk and a pin fixedly coupled to said disk and extending outwardly therefrom into slidable engagement with said camming member, said first abutment and inclined surfaces extending from said ratchet disc.

4. A magazine as in claim 3, wherein said rotating member includes a second abutment surface extending substantially parallel to said longitudinal axis and a second inclined surface extending angularly to said longitudinal axis, said second inclined surface engages said adjacent projection when said rotating member rotates in said second direction such that said adjacent projection slides relative said second inclined surface;

said second abutment surface engages said projection when said rotating member rotates in said first direction to its said first position and rotates said drive member.

5. A magazine as in claim 4, wherein said second abutment and inclined surfaces extend from said ratchet disc.

6. A magazine as in claim 5, wherein said first and second abutment surfaces are directly opposite one another and said first and second inclined surfaces are directly opposite one another.

7. A magazine as in claim 1, wherein said camming member includes a groove having a first end portion extending parallel to said longitudinal axis, a center portion extending angularly to said longitudinal axis and a second end portion extending parallel to said longitudinal axis.

8. A magazine as in claim 7, wherein said first end portion, said center portion and said second end portion form a continuous cam groove.

9. A magazine as in claim 7, wherein said pin engages said first end portion when said camming member is in its said first position and said pin engages said second end portion when said camming member is in its said second position.

10. A magazine as in claim 7, wherein said center portion pivots said rotating member in said first direction as said camming member moves from its said first position to its said second position and pivots said rotating member in said second direction as said camming member moves from its said second position to its said first position.

11. A magazine as in claim 7, wherein said housing includes an L-shaped slot formed adjacent said first end through which said pin extends from said rotating member to said camming member.

12. A magazine as in claim 7, wherein said housing includes a cut-out formed at said second end through which the projectiles are loaded into the gun.

13. A magazine as in claim 1 further comprising a loading member coupled to said first end of said housing for disengaging said rotating member from said drive member so that projectiles can be loaded into said drive member.

14. A magazine as in claim 13 wherein said loading member moves between a first unloaded position and a second loaded position, said rotating member being disengaged from said drive member when said loading member is in said first unloaded position and being engaged with said drive member when said loading member is in said second loaded position.

15. A magazine as in claim 14, wherein said loading member includes a body and an end cap, said end cap receiving said body therethrough and allowing said body to move between said first unloaded position and said second loaded position.

16. A magazine as in claim 15, wherein said end cap is coupled to said first end of said housing.

17. A magazine as in claim 15, wherein said loading member includes a biasing member for biasing said body from said second loaded position to said first unloaded position.

18. A magazine as in claim 1 further comprising a stop member extending into said second end of said housing from said release member and having a biasing surface extending angularly to said longitudinal axis and a stop surface extending substantially parallel to said longitudinal axis, said biasing surface of said stop member engaging said projection at said second end when said rotating member rotates in said first direction such that said projection slides relative said biasing surface, said stop surface of said stop member engaging said adjacent projection at said second end when said rotating member rotates in said second direction and prevents said drive member from rotating.

19. A magazine as in claim 1, wherein each of said projections has an arm extending outwardly and arcuately from said projection adjacent said second end of said housing, said arms guiding the projectiles into said release member.

20. A magazine as in claim 1, wherein said release member includes an arcuate groove for guiding the projectiles into the gun.

21. A magazine as in claim 1, wherein said drive member includes a substantially cylindrical core which extends along said longitudinal axis, said projections extend outwardly from said cylindrical core.

22. A magazine as in claim 21, wherein said drive member includes arms, one of said arms extending outwardly from one of said projections at said second end.

23. A magazine as in claim 20, wherein said drive member includes six said projections spaced evenly apart.

24. An indexing helical magazine for a pellet gun, comprising:

a housing having a first end, a second end, a passageway extending from said first end to said second end along a longitudinal axis, and a helical member extending partially from said first end to said second end into said passageway;

a carrier rotatably coupled within said housing and having a plurality of flutes extending therefrom for guiding the pellets along said helical member;

a release member coupled to said second end of said housing and to said carrier for feeding the pellets from said housing into the gun;

a stop member extending into said housing from said release member having a biasing surface extending angularly to said longitudinal axis and a stop surface extending parallel to said longitudinal axis;

a loading member coupled to said first end of said housing;

a ratchet member coupled to said loading member for rotating said carrier; and a camming member slidably coupled to said ratchet member and movable between a first position and a second position and having a first end portion extending parallel to said longitudinal axis, a center portion extending angularly to said longitudinal axis and a second end portion extending parallel to said longitudinal axis, said ratchet member having a first abutment surface extending parallel to said longitudinal axis and a first inclined surface extending angularly to said longitudinal axis, said ratchet member slidably engaging said camming member as said camming member moves from its said first position to its said second position, said center portion rotating said ratchet member in a first direction with said first inclined surface of said ratchet member engaging said adjacent flute and sliding over said adjacent flute at said first end and said stop surface of said stop member engaging said adjacent flute at said second end and preventing said carrier from rotating, said ratchet member slidably engaging said camming member as said camming member moves from its said second position to its said first position, said center portion rotating said ratchet member in a second direction with said first abutment surface of said ratchet member engaging said flute and rotating said carrier and said biasing surface of said stop member sliding over said flute at said second end, said loading member releasably engaging said ratchet member from said carrier such that the pellets can be loaded into said carrier when said loading member is disengaged from said ratchet member.

* * * * *